US005430597A

United States Patent [19]

Bagepalli et al.

[11] Patent Number: 5,430,597

[45] Date of Patent: Jul. 4, 1995

[54] CURRENT INTERRUPTING DEVICE USING MICROMECHANICAL COMPONENTS

[75] Inventors: Bharat S. Bagepalli, Schenectady; Mario Ghezzo, Ballston Lake; Richard J. Saia; Imdad Imam, both of Schenectady, all of N.Y.

[73] Assignee: General Electric Company, Schenectady, N.Y.

[21] Appl. No.: 313

[22] Filed: Jan. 4, 1993

[51] Int. Cl.[6] ..... H01H 73/00

[52] U.S. Cl. ..... 361/93; 361/115; 200/181; 310/309; 310/350; 257/622

[58] Field of Search ..... 361/93, 115; 200/16 R, 200/181, 61.48; 310/348, 350, 309, 344; 257/621, 622

[56] References Cited

U.S. PATENT DOCUMENTS

| | | | |
|---|---|---|---|
| 3,601,632 | 8/1971 | Frazier | 307/219 |
| 4,570,139 | 2/1986 | Kroll | 335/187 |
| 4,656,445 | 4/1987 | Bagepalli et al. | 335/195 |
| 4,959,515 | 9/1990 | Zavracky et al. | 200/181 |
| 5,149,673 | 9/1992 | MacDonald et al. | 437/192 |
| 5,322,258 | 6/1994 | Bosch et al. | 251/65 |

*Primary Examiner*—Todd DeBoer

*Attorney, Agent, or Firm*—Patrick R. Scanlon; Paul R. Webb, II

[57] ABSTRACT

A circuit interruption device having a plurality of micromechanical switches mounted on a substrate in a parallel-series array. The array includes a plurality of line branches connected in parallel in a circuit line. Each of the line branches has at least two of the switches serially connected therein. The micromechanical switches each has a pair of contacts formed on the substrate, a bridging contact movably formed on the substrate, and an actuator for causing the bridging contact to move in and out of contact with the contacts. The bridging contact can be either a member slidably disposed in a channel formed on the substrate or member attached to an end of a cantilever having its other end attached to the substrate. The actuator is controlled by a trip device which is also mounted on the substrate. The trip device senses the current in the circuit line and causes the switches to open when a predetermined level of current in the line is exceeded.

22 Claims, 4 Drawing Sheets

CURRENT INTERRUPTING DEVICE USING MICROMECHANICAL COMPONENTS

CROSS REFERENCE TO RELATED APPLICATIONS

This application is related to copending application entitled "Micromechanical Moving Structures Including Multiple Contact Switching System, and Micromaching Methods Therefor," Ser. No. 08/000,172, filed concurrently herewith and now U.S. Pat. No. 5,374,792 and assigned to the same assignee as the present invention.

BACKGROUND OF THE INVENTION

This invention relates generally to electrical circuit interrupters and more particularly concerns current limiting breakers using a plurality of micromechanical switches. As used herein, the term "micromechanical" refers to miniscule devices which are fabricated using the technology of micromachining; this involves no assembly operations, but only the selective deposition and removal of materials on a substrate.

Circuit interrupters are designed to protect electrical equipment from damage caused by short circuit faults. Most conventional circuit interrupters are primarily bulky mechanical switches. These devices are capable of sensing a short-circuit current and interrupting the same by opening the switch via a heavy trip mechanism. Typical alternating current circuit breakers require the creation of a large mechanical gap between the contacts of the switch and can only interrupt an alternating current at a zero-crossing. More recently developed current limiting breakers provide the capability of substantially immediately interrupting alternating currents of high magnitude without waiting for a current zero-crossing. However, conventional current limiting breakers are typically complex in construction and thus somewhat expensive to fabricate.

The switch contacts of conventional circuit interrupters require a large contact force be maintained to prevent "popping, " i.e., the unwanted separation of the switch contacts which results from a current-induced repulsive popping force. The contact force is typically provided by adding weight to the contacts and/or adding structure, such as one or more springs, to exert force on the contacts. These measures increase the total weight and cost of the device. A second consideration is that once a short circuit fault is detected, the contacts of the circuit interrupter must be driven apart very rapidly to avoid arcing between them. But since conventional devices typically use heavy mechanical contacts, they either take a relatively long time to open the contacts or consume a large amount of energy to generate a force sufficient to separate the contacts quickly. Thus, conventional circuit interrupters tend to be relatively heavy devices which require high amounts of energy to operate.

Accordingly, there is a need for an electric circuit interrupter in which the overall popping force is reduced, thereby reducing the required contact force. An additional need exists for a circuit interrupter having means for rapidly separating the switch contacts without large energy requirements. Meeting these needs will provide a circuit interrupter which is lightweight and inexpensive to manufacture and requires less energy to operate than conventional devices.

SUMMARY OF THE INVENTION

The above-mentioned needs are generally met in the present invention by providing a circuit interruption device connected in a circuit line. The circuit interruption device comprises a plurality of micromechanical switches and a trip device which opens each of the switches whenever a predetermined level of current in the line is exceeded. The switches are mounted on a small substrate in a parallel-series array comprising a plurality of line branches connected in the line in parallel, each of the line branches having at least two of the switches serially connected therein. Each of the switches comprises a pair of stationary contacts formed on the substrate, a bridging contact movably formed on the substrate, and an actuator for causing the bridging contact to move in and out of contact with the stationary contacts. The bridging contact can be either a member slidably disposed in a channel formed on the substrate or member attached to an end of a cantilever having its other end attached to the substrate.

The trip device, which is also mounted on the substrate comprises a current sensor connected to the line, the current sensor producing a signal whenever the predetermined level of current in the line is exceeded, and a trigger connected to the current sensor which sends a control signal to each of the switches in response to receipt of the signal from the current sensor.

Other objects and advantages of the present invention will become apparent upon reading the following detailed description and the appended claims and upon reference to the accompanying drawings.

DESCRIPTION OF THE DRAWINGS

The subject matter which is regarded as the invention is particularly pointed out and distinctly claimed in the concluding portion of the specification. The invention, however, may be best understood by reference to the following description taken in conjunction with the accompanying drawing figures in which:

DETAILED DESCRIPTION OF THE INVENTION

Figure 1:
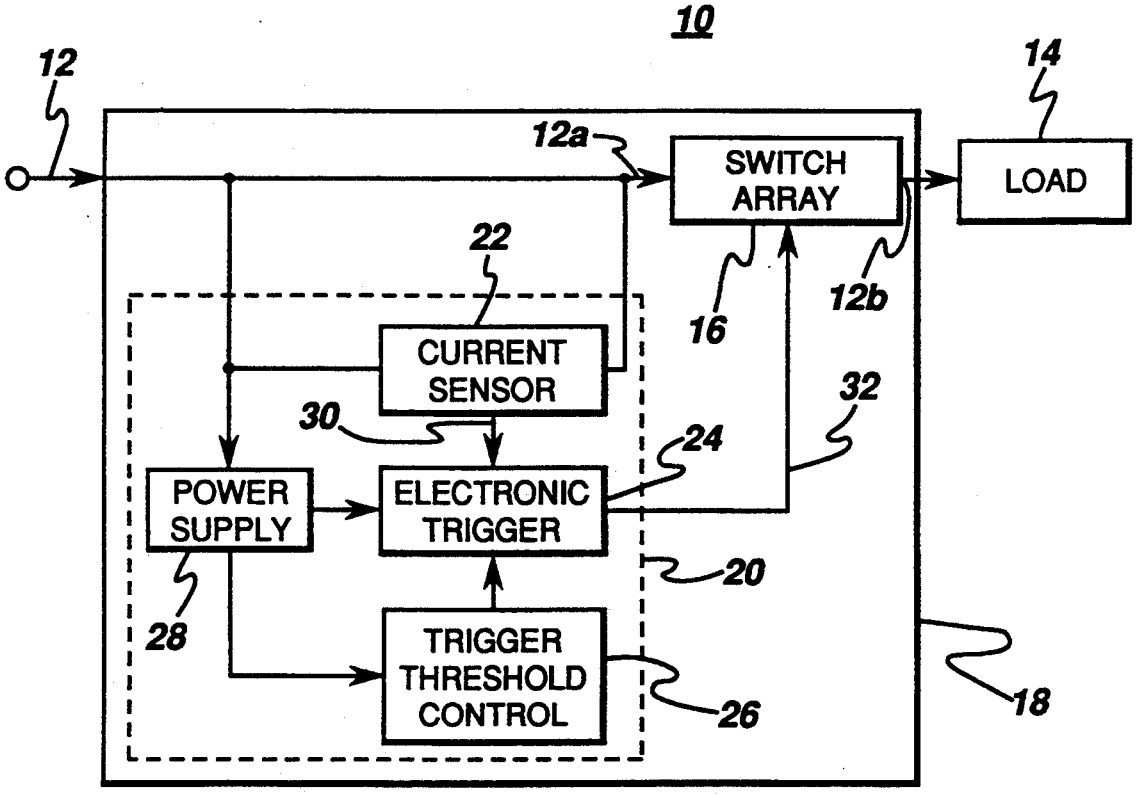
FIG. 1 shows a schematic of the circuit interrupter of the present invention.

Referring to FIG. 1, a circuit interruption device 10 using micromechanical components is shown schematically. The circuit interruption device 10 is connected in a circuit line 12 which delivers electrical energy from a power source (not shown) to a load 14. Specifically, an input **12*a* of the line 12 to the circuit interruption device 10 is connected to a switch array 16 and an output 12*b* of the line 12 is connected between the switch array 16 and the load 14. The switch array 16 comprises a plurality of micromechanical switches which when opened interrupt the flow of current through the line 12. The micromechanical switches are miniscule and several can be incorporated within a very small area. The switch array 16 is supported on a substrate 18** in a manner described in detail below.

A trip device 20 is provided for opening the switches of the switch array 16 at the appropriate time (i.e., a short circuit fault) and interrupting the current flow. The trip device 20, which is also supported on the substrate 18, comprises a current sensor 22, an electronic trigger 24, a trigger threshold control 26 and a power supply 28. The current sensor 22, which may comprise one of many conventional sensors known in the art, is connected to the line 12 and senses the current in the line. The current sensor 22 provides a signal 30 representative of the current level to the electronic trigger 24. As long as the current level represented by the signal 30 does not exceed a predetermined value as set by the trigger threshold control 26, the electronic trigger 24 sends a control signal 32 to the switch array 16 which keeps the switches closed. But when the signal 30 exceeds the predetermined value, the electronic trigger 24 sends a control signal 32 to the switch array 16 which causes the switches to open. The power supply 28 provides power to the electronic trigger 24 and the trigger threshold control 26. Since a relatively small amount is required, the power can be derived from the protected line 12. For example, the power supply 28 can be a charged capacitor or power amplifier connected to the line 12.

Figure 2:
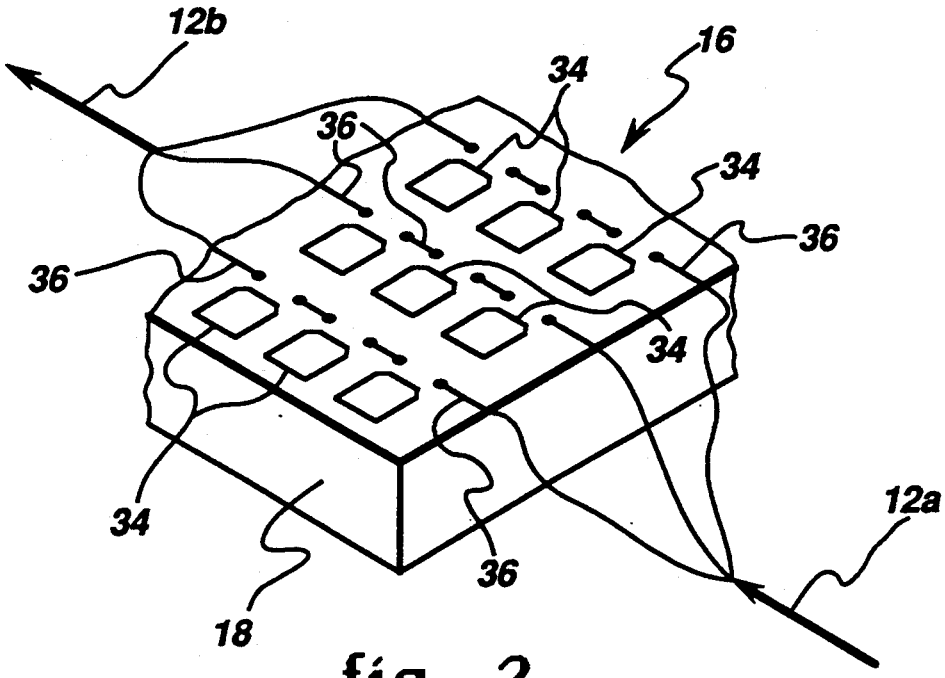
FIG. 2 shows an isometric view of an array of micromechanical switches.

Turning now to FIG. 2, the switch array 16 is shown in more detail. The switch array 16 comprises a plurality of individual micromechanical switches 34 which are formed on the substrate 18 in a series-parallel network. Although a 3-by-3 array of nine switches is shown, this is only illustrative; virtually any number of micromechanical switches can be employed in the present invention. The series-parallel network of switches is formed by providing a plurality of line branches 36 which are connected in parallel to the input and output **12*a*, 12*b* of the protected circuit line. Each of the parallel line branches 36 has a plurality of the micromechanical switches 34 connected in series therein, thus defining the series-parallel network. The switches 34, which are schematically shown with their contacts open in FIG. 2**, are described more fully below.

Figure 3A:
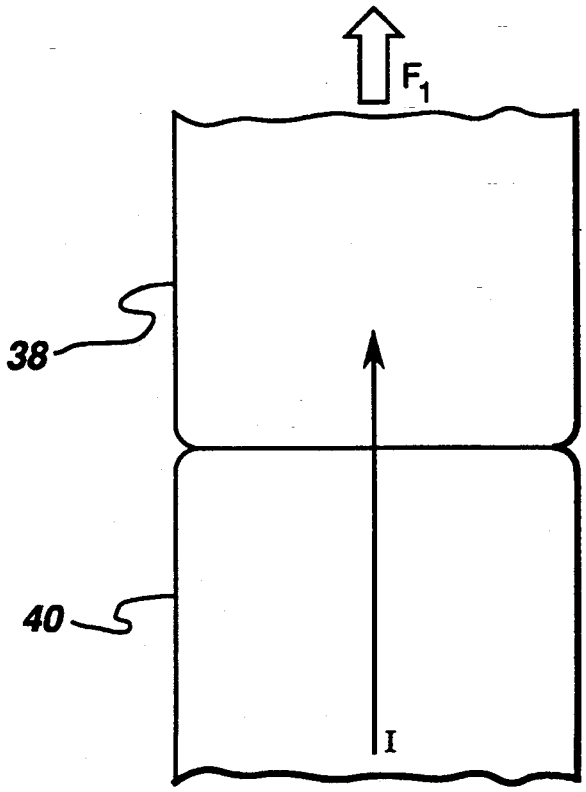
FIGS. 3A and 3B are schematics comparing forces acting on a single contact pair to forces acting on a plurality of parallel contact pairs.
Figure 3B:
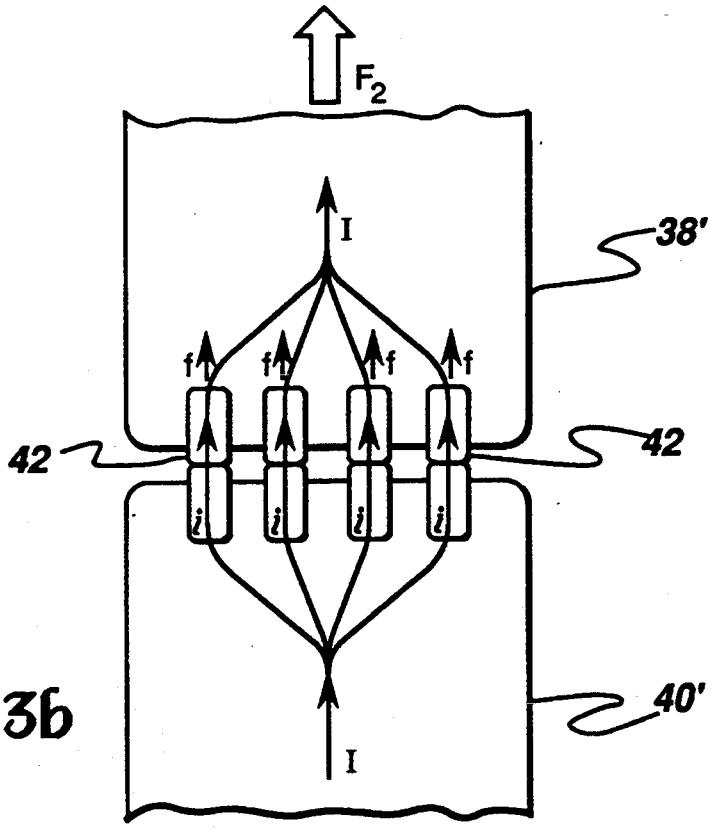

FIGS. 3A and 3B illustrate how a plurality of parallel switches reduce the total popping force in a circuit interrupting device, thus reducing the force needed to overcome the popping force which ultimately reduces the weight and energy consumption of the device. FIG. 3A shows the first and second contacts 38,40 of a conventional mechanical circuit interrupter. The line current I which flows through the contacts 38,40 produces a popping force $F_1$ which is proportional to the square of the line current I and tends to drive the contacts 38,40 apart. FIG. 3B shows a modified circuit interrupter having a plurality of small contact pairs 42 connected in parallel and supported by two current conducting members 38',40'. While the two current conducting members 38',40' carry the full line current I, each one of the small contact pairs carries an equal portion of the line current I, referred to herein as the branch current i. Accordingly, the individual popping force f acting on each of the small contact pairs 42 is proportional to the square of the branch current i. The total force $F_2$ acting to separate the two conducting members 38',40' is equal to the sum of the individual popping forces f.

Now assuming that there are "n" parallel small contact pairs, then it is known from the above discussion that:

$$F_2=\Sigma f=nf;\ f=F_2/n, \tag{1}$$

$$i=I/n, \text{ and} \tag{2}$$

$$f\propto i^2 \tag{3}$$

substituting equations (1) and (2) into the relationship (3) gives:

$F_2/n\propto(I/n)^2$, which can be simplified as:

$F_2\propto(1/n)I^2$.

Since, as stated above, the popping force $F_1$ is proportional to the square of the line current I ($F_1\propto I^2$), then for an equal line current I, the total force $F_2$ acting to separate the branch contacts would be only 1/n of the total force $F_1$ for a single contact pair. Thus, by providing a plurality of parallel line branches 36, the present invention reduces the force needed to keep the switches 34 closed.

The serial connections of the switches 34 along each line branch 36 in the series-parallel switch array 16 also provide a reduction in the amount of energy needed to operate the device. In circuit interrupters, the contacts must be opened to a sufficient spacing within a given time period to avoid arcing therebetween. For instance, assume it is necessary to open the contacts to a gap "D" within a time "t" to avoid arcing. The force needed to do this would be equal to the mass of the movable contact (assuming the other contact remains stationary) times the acceleration of the movable contact. The acceleration is equal to the double derivative of the distance D with respect to time. Thus, the contact opening force necessary to avoid arcing could be reduced by reducing the mass of the movable contact and the required gap distance between contacts. Reduction of the required opening force reduces energy consumption.

In the present invention, the serial connection of the switches 34 along each line branch 36 reduces the required gap distance between individual pairs of contacts. This is based on the premise that if a switch carrying a certain current must be opened to a gap distance "D" in a time "t" to avoid arcing between the contacts, then it is just as acceptable to have "n" number of serially connected switches carrying the same current and forming "n" gaps, where each gap is equal to 1/n times "D" and each switch simultaneously opens in the same time "t." Accordingly, each simultaneously moving contact has to move through 1/n of the distance that the conventional contact needs to move through in the same time period, thereby lowering the required acceleration of the contacts. Furthermore, the use of micromechanical switches in the present invention reduces the mass to be moved to open the contacts, thereby further reducing the necessary contact opening force. These micromechanical switches 34 are so small that even if a very large number is used, the combined mass of the moving contacts is less than the mass of the moving contact of a conventional mechanical switch.

Figure 4:
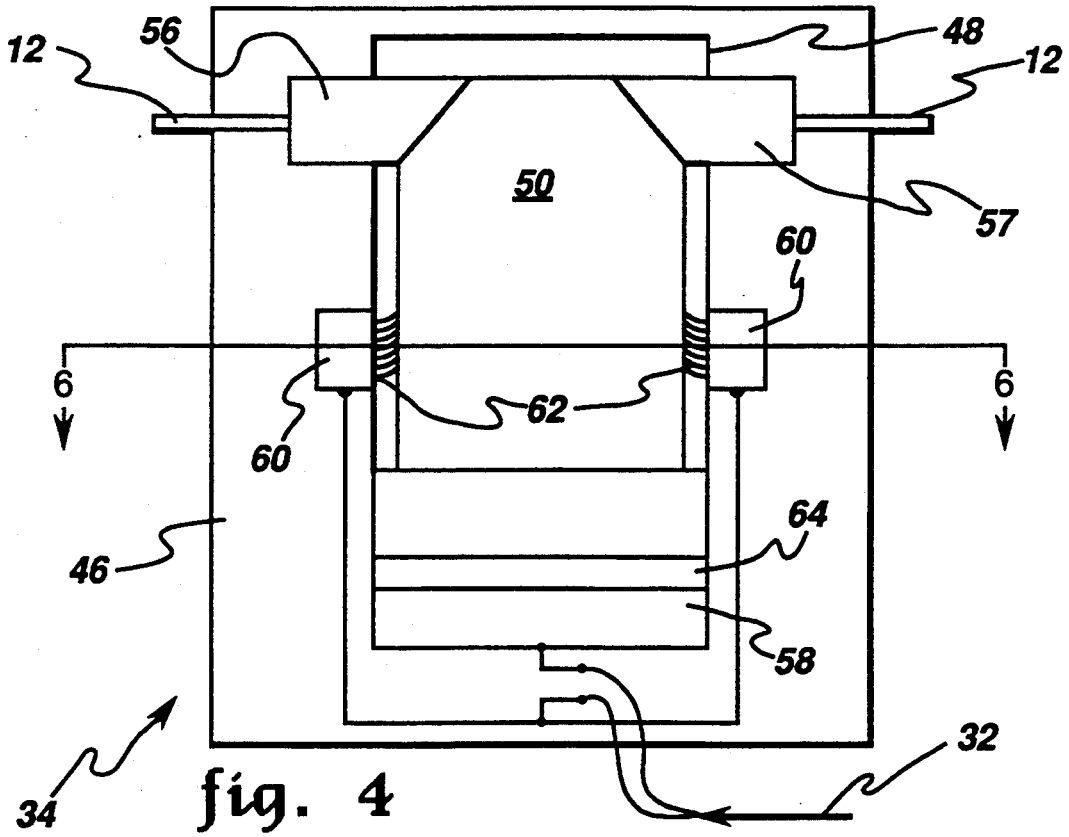
FIG. 4 shows a micromechanical switch of the present invention with the contacts closed.
Figure 5:
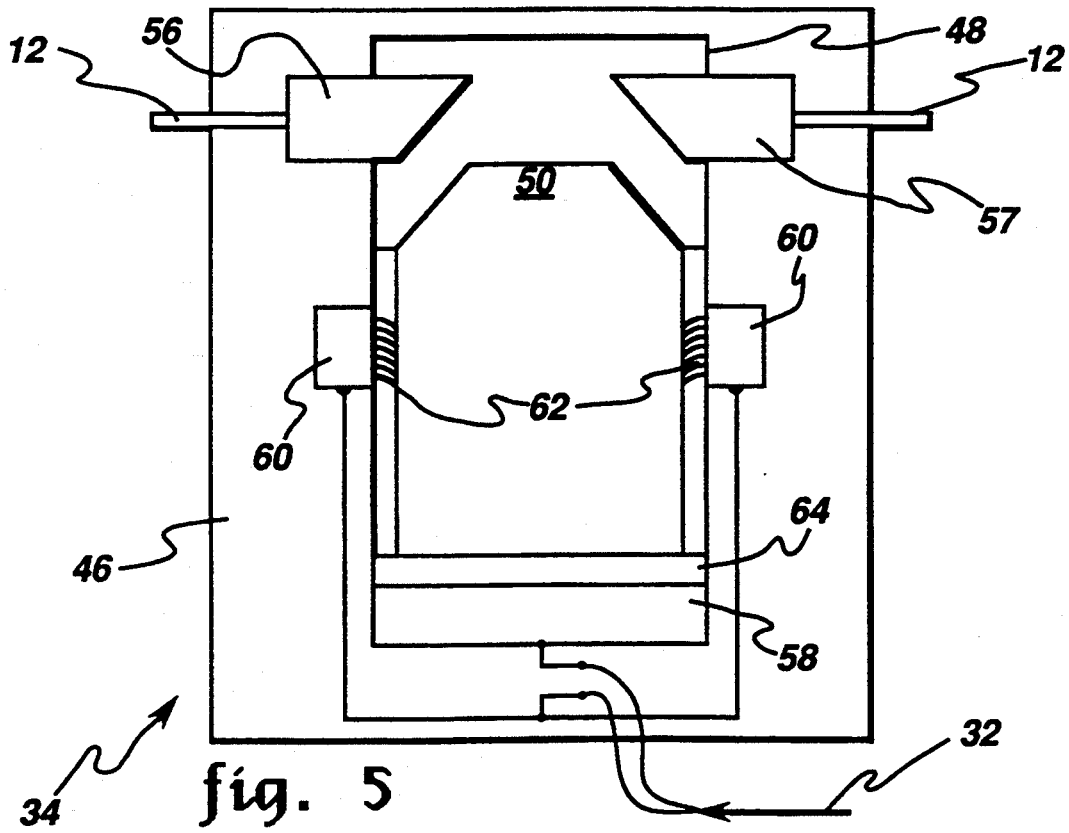
FIG. 5 shows the micromechanical switch of FIG. 4 with the contacts open.
Figure 6:
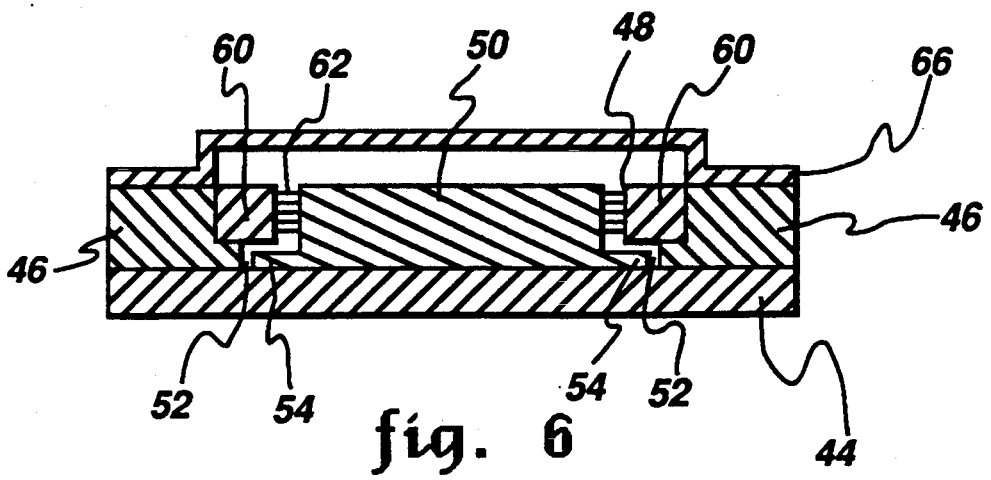
FIG. 6 shows a cross-sectional view of the micromechanical switch of FIG. 4 taken along the line 6—6.

FIGS. 4–6 show in detail a micromechanical switch 34 suitable for use in the present invention. The switches are termed "micromechanical" for two primary reasons. First, they are of miniscule size—on the scale of a few square millimeters. Second, they are fabricated using micromachining techniques which are similar to the techniques used in the fabrication of integrated circuits. These techniques entail selectively depositing and removing materials from a substrate and do not include mechanical assembly. Furthermore, batch fabrication, i.e., fabricating multiple devices in a batch on a single wafer, can be used to spread processing costs among the several individual devices.

The switch 34 comprises a substrate 44 (FIG. 6) which is preferably made of a silicon or ceramic material. An insulator base 46 is formed on the top of the substrate 44. The insulator base 46 is preferably made of an oxide material such as silicon oxide. A channel 48 is formed in the insulator base 46 and a movable contact 50 is disposed in the channel 48 in such a manner as to be capable of sliding back and forth in the channel 48. As is best seen in FIG. 6, the channel 48 has grooves 52 formed along two opposing bottom edges thereof. The grooves 52 are adapted to receive two retaining flanges 54 which are provided on opposite sides of the movable contact 50, thereby retaining the movable contact 50 in the channel 48 and guiding its movement along the channel 48. As stated above, the present invention is fabricated by employing integrated circuit chip technology. Making the movable contact 50 capable of movement with these fabrication techniques requires the provision of a sacrificial layer (not shown) which is first formed in the channel 48 prior to deposition of the movable contact 50. Once the movable contact 50 is formed, the sacrificial layer is removed, thereby freeing the movable contact 50 for movement.

Two stationary contacts 56,57 are placed on opposing sides of the channel 48 at one end thereof. The first stationary contact 56 is connected to the incoming portion of the line 12, and the second stationary contact 57 is connected to the outgoing portion of the line 12. The movable contact 50 is adapted to slide in and out of contact with the two stationary contacts 56,57 which have beveled surfaces matching similarly beveled surfaces on the movable contact 50. The stationary contacts 56,57 and the movable contact 50 are made of an electrically conducting metal such as copper or tungsten so that when the movable contact 50 is in contact with the stationary contacts 56,57, it provides a bridge between the stationary contacts 56,57 to conduct the current in the line 12. When the movable contact 50 is displaced from the stationary contacts 56,57, the current is not conducted.

The movement of the movable contact is induced by an actuator assembly mounted on the substrate 44. FIGS. 4–6 show an electrostatic actuator which is used with the present invention; however many other types of actuators could be used. Electromagnetic, piezoelectric and bimetallic actuators are all examples of possible alternatives. For example, the above-mentioned U.S. Pat. No. 5,374,792 hereby incorporated by reference, describes a suitable electromagnetic actuator.

The electrostatic actuator of FIGS. 4–6 comprises a first electrode 58 disposed in the channel 48 at the end opposite from the stationary contacts 56,57. Two secondary electrodes 60 are disposed on opposing sides of the channel 48 at a point along the channel 48 which remains adjacent to the movable contact 50 throughout its range of motion. The secondary electrodes have sliding contacts 62 such as brush contacts which provide an electrical connection between the secondary electrodes 60 and the movable electrode 50. Suitable conductors are provided so that a voltage can be applied across the first electrode 58 and the secondary electrodes 60. An insulating block 64 is provided in the channel 48 adjacent to the first electrode 58 to prevent the movable contact 50 from contacting the first electrode 58, thereby avoiding a short circuit.

In operation, the control signal 32 from the electronic trigger 24 discussed above provides the voltage across the electrodes. Depending on the nature of this applied voltage, either an attractive or repulsive electrostatic force will be created between the first electrode 58 and the movable contact 50. If it is strong enough to overcome the popping force, a repulsive force will keep the movable contact 50 in contact with the stationary contacts 56,57. An attractive force between the movable electrode 50 and the first electrode 58 will separate the movable contact 50 from the stationary contacts 56,57. Thus, as long as the current sensor 22 does not sense a short circuit, the electronic trigger 24 sends a control signal 32 which produces a repulsive force, thereby keeping the switches closed. When the current sensor 22 senses a short circuit, the electronic trigger 24 sends a control signal 32 which produces an attractive force and causes the switches to open. Generally, a voltage having a magnitude of about 15 volts is sufficient to overcome the popping force when maintaining contact and separate the contacts rapidly enough to avoid arcing when opening the contacts.

As best seen in FIG. 6, a sealed cover 66 is placed over the insulator base 46 to enclose the channel 48 and all of the elements therein, thereby protecting the micromechanical switch from exposure to contaminants. The enclosed space is preferably filled with an inert gas to retard oxidation or other deterioration of the micromechanical elements.

Figure 7:
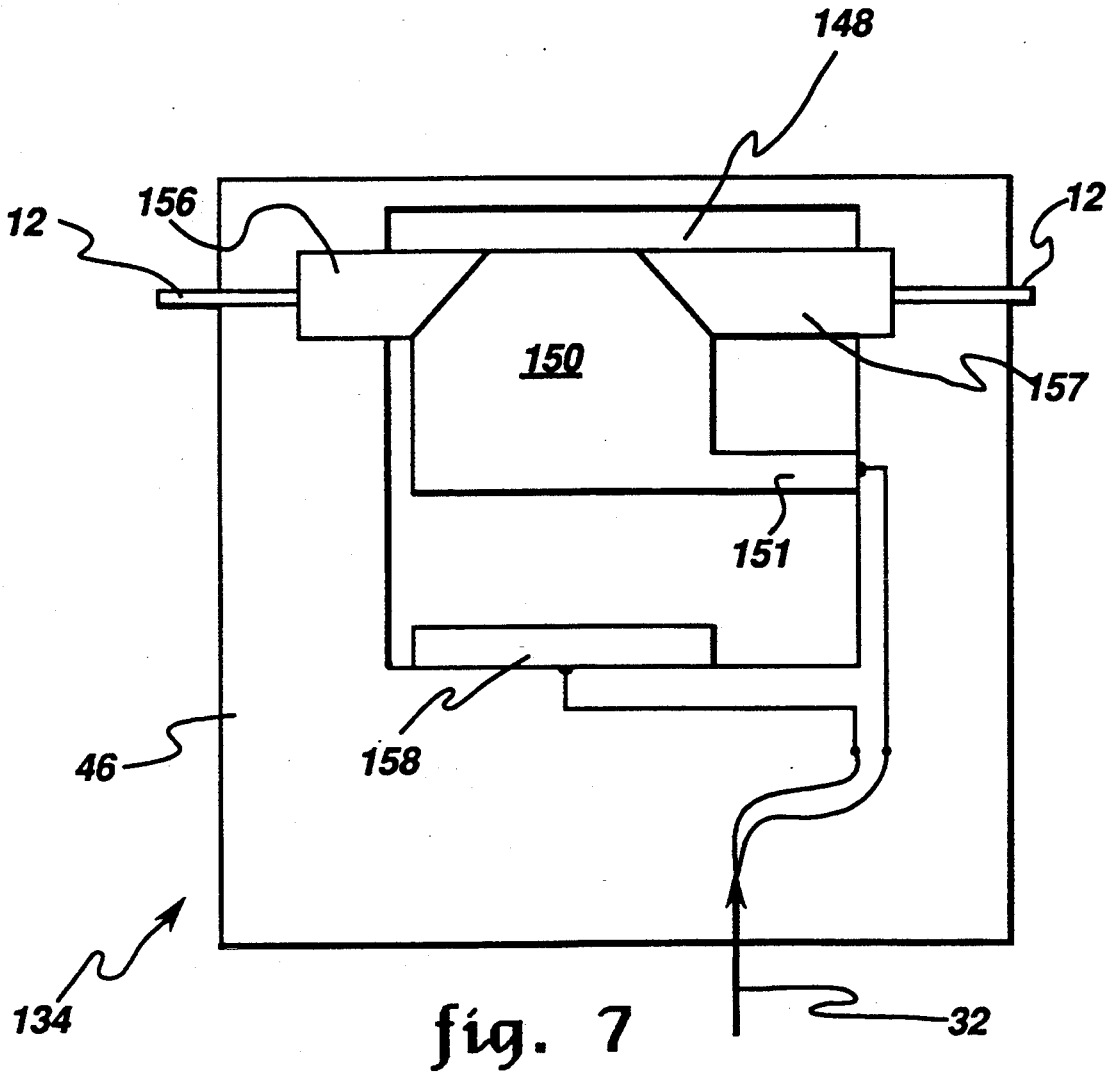
FIG. 7 shows a second micromechanical switch of the present invention.

FIG. 7 shows a second embodiment of a micromechanical switch 134 which is suitable for use with the present invention. As in the first embodiment, the switch 134 comprises an insulator base 146 mounted on a substrate (not shown). A channel 148 is formed in the insulator base 146 and has a movable contact 150 disposed therein. The movable contact 150 is movably supported by a cantilever 151 which is an elongated beam extending from one corner of the movable contact 150 and attached to a side wall of the channel 148. Two stationary contacts 156,157 are placed on opposing sides of the channel 148 at one end thereof. The first stationary contact 156 is connected to the incoming portion of the line 12, and the second stationary contact 157 is connected to the outgoing portion of the line 12. Flexure of the cantilever 151 permits the movable contact 150 to move in and out of contact with the two stationary contacts 156,157 to respectively close and open the circuit. An electrode 158 is disposed in the channel 148 at an end opposite from the two stationary contacts 156,157. Suitable conductors are provided so that a voltage can be applied across the electrode 158 and the movable contact 150. As in the embodiment of FIGS. 4–6 described above, application of the voltage is controlled by the electronic trigger 24 to create either a repulsive force or an attractive force between the electrode 158 and the movable contact 150. As before, a repulsive force will keep the contacts closed, and an attractive force will open the contacts.

FIGS. 4–7 show just two possible embodiments of micromechanical switches which can be used in the present invention. Many other switch embodiments are applicable. For example, the above-mentioned which has been incorporated by reference, discloses another micromechanical switch which is suitable for use with the present invention.

The foregoing has described an improved circuit interruption device in which the contact popping force is reduced so as to provided a lightweight and inexpensive device. The device is also fast-responding and requires little energy to operate.

While specific embodiments of the present invention have been described, it will be apparent to those skilled in the art that various modifications thereto can be made without departing from the spirit and scope of the invention as defined in the appended claims.

What is claimed is:

1. A micromechanical switch comprising:
a substrate;
a pair of contacts formed on said substrate;
a channel formed on said substrate;
a bridging contact slidably disposed in said channel; and
an actuator for causing said bridging contact to move in and out of contact with said contacts.

2. The micromechanical switch of claim 1 wherein said actuator comprises:
a first electrode formed at one end of said channel;
at least one other electrode formed along said channel, said at least one other electrode being electrically connected to said bridging contact; and
means for applying a voltage between said first electrode and said at least one other electrode.

3. The micromechanical switch of claim 1 further comprising a cantilever attached at one end to said substrate, said bridging contact being attached to the other end of said cantilever.

4. The micromechanical switch of claim 3 wherein said actuator comprises:
a first electrode formed at one end of said channel;
a second electrode formed on said bridging contact; and
means for applying a voltage between said first and second electrodes.

5. The micromechanical switch of claim 1 wherein said actuator comprises:
a first electrode formed on said substrate;
a second electrode associated with said bridging contact; and
means for applying a voltage between said first and second electrodes.

6. A circuit interruption device for insertion in a circuit line, said circuit interruption device comprising:
a plurality of micromechanical switches, each switch including a bridging contact slidably disposed on a substrate and
a trip device which opens each of said switches whenever a predetermined level of current in the line is exceeded.

7. The circuit interruption device of claim 6 wherein said trip device comprises:
a current sensor which produces a signal whenever the predetermined level of current in the line is exceeded; and
a trigger connected to said current sensor which sends a control signal to each of said switches in response to receipt of said signal from said current sensor.

8. The circuit interruption device of claim 6 further comprising a plurality of line branches, each one of said line branches being connected in parallel and having at least one of said switches connected therein.

9. The circuit interruption device of claim 8 wherein each one of said line branches has at least two of said switches connected serially therein.

10. The circuit interruption device of claim 6 wherein said plurality of switches are connected in parallel.

11. The circuit interruption device of claim 6 wherein said plurality of switches are connected in a parallel-series array.

12. The circuit interruption device of claim 6 wherein said switches are mounted on a single substrate.

13. The circuit interruption device of claim 12 further comprising a plurality of line branches, each one of said line branches being connected in parallel and having at least one of said switches connected therein.

14. The circuit interruption device of claim 13 wherein each one of said line branches has at least two of said switches connected serially therein.

15. The circuit interruption device of claim 12 wherein said plurality of switches are connected in parallel.

16. The circuit interruption device of claim 12 wherein said plurality of switches are connected in a parallel-series array.

17. The circuit interruption device of claim 12 wherein each one of said switches further comprises;
a pair of contacts formed on said substrate; and disposed
an actuator for causing said bridging contact to move in and out of contact with said contacts.

18. The circuit interruption device of claim 17 wherein each one of said switches further comprising a channel formed on said substrate, said bridging contact of each respective switch being slidably disposed in the respective channel.

19. The circuit interruption device of claim 17 wherein each one of said switches further comprising a cantilever attached at one end to said substrate, said respective bridging contact of each respective switch being attached to the other end of the respective cantilever.

20. The circuit interruption device of claim 12 wherein said trip device is mounted on said substrate, said trip device comprising:
a current sensor which produces a signal whenever the predetermined level of current in the line is exceeded; and
a trigger connected to said current sensor which sends a control signal to each of said switches in response to receipt of said signal from said current sensor.

21. A method for interrupting a circuit having a line, said method comprising the steps of:
dividing the line into a plurality of parallel branches;
providing at least one micromechanical switch which includes a bridging contact slidably disposed on a substrate in each one of the branches;
sensing the current in the line; and
opening the switches whenever the sensed current level exceeds a predetermined level.

22. The method of claim 21 wherein said step of providing at least one switch in each one of the branches comprises providing at least two serially connected switches in each one of the branches.

* * * * *